United States Patent [19]

Macosko

[11] Patent Number: 4,497,485

[45] Date of Patent: Feb. 5, 1985

[54] BASEBALL PITCHING TARGET

[76] Inventor: Robert L. Macosko, 9701 Nila Ave., Chatsworth, Calif. 91311

[21] Appl. No.: 616,838

[22] Filed: Jun. 4, 1984

[51] Int. Cl.[3] ..... A63B 69/40

[52] U.S. Cl. ..... 273/26 A; 273/401; 273/407

[58] Field of Search ..... 273/26 A, 26 R, 29 A, 273/176 B, 177 A, 181 R, 181 A, 181 F, 181 J, 181 K, 35 R, 407, 401, 396

[56] References Cited

U.S. PATENT DOCUMENTS

| | | | |
|---|---|---|---|
| 2,254,986 | 9/1941 | Ziel | 273/26 A |
| 2,895,737 | 7/1959 | Blees | 273/26 A |
| 2,944,816 | 7/1960 | Dixon | 273/26 A |
| 3,583,703 | 6/1971 | Brown | 273/26 A |
| 3,633,909 | 1/1972 | Doynow | 273/26 A |
| 3,672,672 | 6/1972 | Rubin | 273/26 A |
| 3,706,451 | 12/1972 | Dixon | 273/26 A |
| 3,711,092 | 1/1973 | Hogue | 273/26 A |
| 3,810,616 | 5/1974 | Murphy | 273/26 A |
| 3,810,618 | 5/1974 | Nedwick | 273/401 |
| 4,148,555 | 4/1979 | Lerman et al. | 273/26 A |
| 4,254,952 | 3/1981 | Playter | 273/401 |

*Primary Examiner*—Richard C. Pinkham
*Assistant Examiner*—T. Brown
*Attorney, Agent, or Firm*—Paul H. Ware

[57] ABSTRACT

A baseball pitching target comprising a rectangular peripheral tubular frame supported by support members staked to the ground and having a mesh backstop itself having an insert that represents such target indicia as the catcher's chest protector, shoulder pads and knee protector pads and mitt. Pitched balls are collected in a compartmentalized ball receiving bag except for those pitched balls that miss the strike zone. Those missing the strike zone will be projected back toward the pitcher by the action of the spring-mesh structure of the backstop.

4 Claims, 5 Drawing Figures

BASEBALL PITCHING TARGET

BACKGROUND OF THE INVENTION

1. Field of the Invention

This invention relates generally to baseball pitching targets and more particularly to a baseball pitching target that, though having no moving parts, can give an indication of the accuracy of the pitched balls by means of an arrangement for collecting the pitched balls that are on-target in a compartmentalized collecting bag and projecting pitched balls that are off-target back toward the pitcher.

2. Description of the Prior Art

Baseball pitching targets are known in which indicia of accuracy or scoring are provided, however, these prior art baseball pitching targets have been complicated and therefore expensive to manufacture and, when furnished to the user in an unassembled state, difficult to assemble. Some have provided elaborate electronic scoring mechanisms which, while quite interesting when they are operating properly, are subject to failure. The user is then, rarely equipped to effect repairs and must obtain competent technical assistance which may often be very expensive. On the other hand, some of the prior art targets are little more than a receptive sack that collects the pitched balls thrown at it that enter the mouth of the sack.

Most of these devices have thus met special needs as presented by specific problems and have, therefore, served narrow purposes. Some of these prior art pitching targets have been described in the following listed patents that were brought to the attention of the applicant through a novelty search conducted in the United States Patent and Trademark Office:

| U.S. Pat. No. | Patentee | Title |
|---|---|---|
| 4,148,555 | Lerman | Target With Score Indicator |
| 4,118,028 | Larkin | Pitching Target With Ball Collector |
| 3,997,158 | Briitton | Strike Zone Target |
| 3,963,240 | Tidwell | Aiming and Scoring Attachment for Pitchback Nets |
| 3,810,616 | Murphy | Target Apparatus With Ball Catching Means |
| 3,752,476 | Mahoney | Projectile Return Apparatus |
| 2,628,097 | Lecznar | Pitcher's Control Practice Target |
| 2,254,986 | Ziel | Target |

It would thus be a great advantage to the art to provide a baseball pitching target with no moving parts.

Another great advantage would be to provide a baseball pitching target suitable for use by pitchers ranging in age from pre-teenage children to mature adults.

A further desirable advantage would be realized by the provision of indicia of accuracy in the arrangement of the elements of a baseball pitching target.

A still further beneficial advantage would be enjoyed if means were found by which to provide a baseball pitching target with sight indicia normally seen by a pitcher in an actual baseball environment.

SUMMARY OF THE INVENTION

It is therefore an object of the present invention to provide a baseball pitching target with no moving parts that yet may provide for indicia of accuracy through the arrangement of the elements of the device.

A further object of the present invention is the provision of a baseball pitching target suitable for use by young and old.

A still further object of the invention herein described is to provide a baseball pitching target in which the pitcher sees normal sight indicia such as the catcher's mitt, knee protectors, chest protectors and the shoulders.

In the accomplishment of these and other objects a baseball pitching target is provided in which a pitched ball, missing a rectangular strike zone, will be projected back toward the pitcher. On the other hand, a pitched ball pitched into the strike zone will be collected and retained by the target in one of three compartments of a compartmentalized ball receiving bag according to the region of the strike zone into which the ball was pitched.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which.

DETAILED DESCRIPTION

Figures 1, 2, 3, 4, 5:
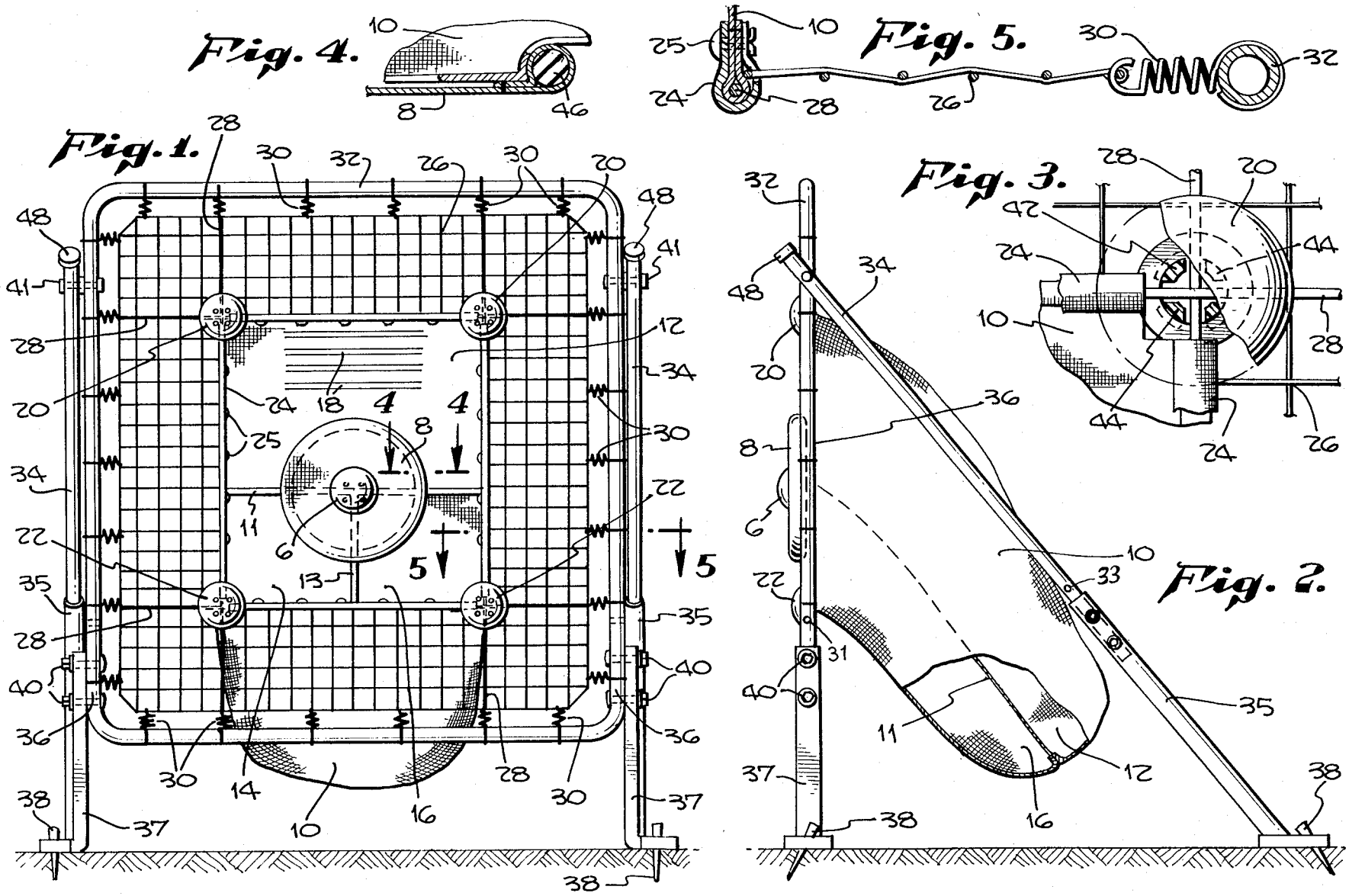
FIG. 1 is an idealized front elevational schematic drawing showing the arrangements of the parts from the point of view of a using pitcher.
FIG. 2 is a side elevation of the apparatus.
FIG. 3 is an enlarged detail drawing showing details of a fastening button used with a target disc.
FIG. 4 is a detail drawing of an enlargement of a cross-section taken along the sight lines 4—4.
FIG. 5 is a detail drawing of an enlargement of a cross-section taken along the sight lines 5—5.

Although specific embodiment of the invention will now be described with reference to the drawings, it should be understood that such embodiments are by way of example only and merely illustrative of but a small number of the many possible specific embodiments which can represent applications of the principles of the invention. Various changes and modifications, obvious to one skilled in the art to which the invention pertains are deemed to be within the spirit, scope and contemplation of the invention as further defined in the appended claims.

Referring to FIGS. 1 and 2 with greater particularity, there is illustrated in idealized schematic diagram the pitching target, both as seen by a using pitcher in FIG. 1 and from a side perspective in FIG. 2. The peripheral main frame 36 is shown supported within the structure of front support member 37 which is staked to the ground by ground stakes 38. Adjustable telescoping brace member 34, telescoped into telescoping brace member receiving member 35, supports main frame 36 and the assembly of brace member 34 and its receiving member 35 is staked to the ground by ground stakes 38. The tops of members 34 are protected by plastic safety caps 48. The frame assembly and its supporting structure are secured together by double nut and bolt assembly 40 and upper frame nut and bolt assembly 41. Adjustment holes in the main frame 36 and in adjustable telescoping brace member 34 are denoted by numerals 31 and 33 respectively.

A generally rectangular portion of mesh netting 26 is secured to the main frame 36 by means of net and bag retaining springs 30. Large cords 28 cooperate with said retaining springs 30 and said mesh netting to position the strike zone to be described hereinafter. As illustrated, four of these large cords 28, attached as shown to main frame 36 by resilient net and bag retaining springs 30, define a strike zone or rectangular insert region. At each upper corner of said strike zone, shoulder target discs 20 are secured by means of fastening buttons 6. At the lower corners of the strike zone, catcher's knee protector target discs are also secured by means of fastening buttons 6.

Compartmentalized ball receiving bag 10 has its mouth attached to said strike zone or rectangular insert region and also to said large cords 28 and said mesh netting 26 by means of U-channel structure for cord protector and bag and net retainer 24 and firmly secured thereto by means of U-channel fasteners 25. Compartmentalized ball receiving bag 10 has an upper chamber 12 divided from its lower compartment by bag center wall 11. The lower chamber of ball receiving bag 10 is itself divided into two separate compartments by bag divider wall 13 thereby forming lower left-hand chamber 14 and lower right-hand chamber 16. Each chamber so defined is provided with reinforcing large cords for structural integrity and to provide supporting structure for holding the simulated catcher's mitt in position.

A simulated catcher's mitt 8 is thus supported at the juncture of the bag center wall 11 with bag divider wall 13 by means of a fastening button 6 secured to said reinforcing large cords. Above simulated catcher's mitt 8, the ribs of the catcher's chest protector have also been simulated for greater realism.

Referring now to FIG. 3, the means of attaching the catcher's mitt, target discs, both the shoulder target discs 20 and the catcher's knee protector target discs 22, may be explained. Fastening button 6 has flexible retaining fingers 44 that may be snapped into retaining position by means of a fastening button lockwasher 42. The plastic fastening button utilized here is an item of common hardware and, as such, does not form a part of applicant's invention. In FIG. 3, the junction of large cords 28, one vertical and one horizontal as shown, also defines the position of one of the target discs 20 or 22 and the meeting of U-channel structures 24, also one vertical and one horizontal as shown. Fastening button 6, by means of lock washer 42 and flexible fingers 44, secures large cords 28 to target disc 20 as shown in FIG. 3, however, the same attachment is provided for target discs 22.

Referring to FIG. 4, resilient retaining means 46 that forms the periphery of the catcher's mitt 8 is shown in enlarged detail. The catcher's mitt 8 is shown looped around retaining means 46 and secured thereby to ball receiving bag 10.

FIG. 5 shows detail of the attachment of net and ball retaining springs 30 to the pitching target's main frame 36 and mesh netting 26. Detail of U-channel fasteners 25, fastening U-channel structure 24 to ball receiving bag 10, the large cord, ball position holder formed by large cords 28 and mesh netting 26, is also illustrated.

In use, the baseball pitching target of the present invention is intended to represent the prominent target indicia seen by the pitcher when standing on the pitcher's mound in an actual baseball game environment. For example, the pitcher sees a catcher's mitt with a catcher's chest protector directly behind it and also the kneecap protection pads and the shoulders of the catcher. The pitcher's primary target, when throwing, is the catcher's mitt, however, the complete and overall target is behind the home plate. The catcher's kneecap protector pads mark the limits of the lower portion of the strike zone while his shoulders, extending out from each side of the chest protector, determine the upper boundary of the strike zone. The U-channel structures, secured firmly to the large cords, exhibit clearly the lateral boundaries of the strike zone.

The catcher's mitt is intended to be formed of a flexible, leather-like material with a resilient outer member that will maintain its circumferential shape. The mitt is located in the lower central portion of the target zone and secured in that position by a fastening button as has been described. Directly behind the catcher's mitt and the strike zone, the compartmentalized ball receiving bag is attached to the large cord bag position holder formed by large cords 28 and the U-channel structure, and secured thereto by a multiplicity of U-channel fasteners. The ball receiving bag, divided into three separate chambers, gives an indication of just where in the strike zone those pitched balls that were incident within the strike zone, actually were received. These chambers were intended to receive a pitched ball thrown at the catcher's mitt. The catcher's mitt, being very flexible, will bend when a pitched ball hits it. For example, a pitcher who is pitching at the target can control his pitches by applying various pressures on the ball so that the ball will go low and inside for a right-handed batter into chamber 16 or low and outside into chamber 14 or he could throw the ball high so that it will be retained in upper chamber 12. The strike zone, as explained above, is outlined by the four large cords of very strong material, for example, Nylon, that also suspend the compartmentalized ball receiving bag in the central position relative to the mesh netting material that surrounds the mouth of the bag. If the pitcher misses the strike zone and throws a "ball" so as to strike the mesh netting material, the pitched ball will be returned toward the pitcher under the action of the resilience of the mesh netting and the net and bag retaining springs. The pitcher then has an opportunity to come off of the mound and make a fielding play at the ball on the ground thus adding the realism of the batter's having hit the ball.

The shoulder and knee target discs are held in place by plastic fastening buttons. In order to assure that no pitched balls get through between the netting and the ball receiving bag, the U-channel structure is positioned to protect the large cords from excessive wear and to seal up any openings between the netting and the ball receiving bag.

The position of the peripheral main frame is adjustable in height by means of the front support members which are bolted to the frame. The adjustable brace keeps the main frame in an upright position and holds it upright when the ball hits the front of the net so that it doesn't tip over. Ground stakes anchor both the adjustable support legs or front support members and the adjustable braces to the ground. By having these adjustments, one can raise or lower the strike zone by unbolting the bolts from the frame and braces and repositioning them in the holes provided. Thus, the strike zone for young children will be lower than for young adults and adults. For example, by making the lowering adjustments, the top 32 of the peripheral main frame may be brought lower in height until the bottom of the frame rests on the ground.

Thus, there has been described a pitching target that, though having no moving parts involved in its operation, will provide an indication of the accuracy achieved by a practicing pitcher. The pitching target, as described, is easy to assemble and use and will require very little in the way of maintenance. It is economical and may be used by all interested age groups.

It is pointed out that although the present invention has been shown and described with reference to particular embodiment, nevertheless, various changes and modifications, obvious to one skilled in the art to which the invention pertains, are deemed to lie within the purview of the invention.

ABSTRACT OF THE DRAWINGS

In the drawings, the numbers refer to like parts and, for the purpose of explication, set forth below are the numbered parts of the Big League Pitching Target of this invention.

| Reference | Identification | In FIGS. |
|---|---|---|
| 6 | Fastening button | 1,2 |
| 8 | Simulated catcher's mitt | 1,2,4 |
| 10 | Compartmentalized ball receiving bag | 1,2,3,4,5 |
| 11 | Bag center wall | 1,2 |
| 12 | Upper chamber | 1,2 |
| 13 | Bag divider wall | 1 |
| 14 | Lower left-hand chamber | 1 |
| 16 | Lower right-hand chamber | 1,2 |
| 18 | Chest protector ribs | 1 |
| 20 | Shoulder target discs | 1,2,3 |
| 22 | Knee protector target discs | 1,2 |
| 24 | U-channel structure | 1,3,5 |
| 25 | U-channel fastener | 1,5 |
| 26 | Mesh netting | 1,3,5 |
| 28 | Large cord | 1,3,5 |
| 30 | Retainer springs | 1,5 |
| 31 | Main frame adjustment hole | 2 |
| 32 | Top of main frame | 1,2,5 |
| 33 | Brace adjustment hole | 2 |
| 34 | Adjustable telescoping brace member | 1,2 |
| 35 | Telescoping brace member receiving member | 1,2 |
| 36 | Peripheral main frame | 1 |
| 37 | Front support member | 1,2 |
| 38 | Ground stakes | 1,2 |
| 40 | Double nut and bolt assembly | 1,2 |
| 41 | Upper frame nut and bolt assembly | 1 |
| 42 | Fastening button lock washer | 3 |
| 44 | Cord retaining fingers | 3 |
| 46 | Resilient retaining means | 4 |
| 48 | Plastic safety caps | 1,2 |

What is claimed and desired to be secured by Letters Patent of the United States is:

1. A baseball pitching target for receiving pitched baseballs, comprising in combination:

a peripheral main frame of generally rectangular configuration having rounded corners;

a generally rectangular portion of mesh netting within the periphery of said main frame;

net and bag retaining springs attaching said mesh netting to said peripheral main frame;

a front support member attached to said peripheral main frame and to the ground;

two adjustable telescoping brace members, each attached to the ground and to one side of the upper portions of said main frame;

a rectangular insert region or strike zone attached to said mesh netting and approximately centrally located within said generally rectangular portion of said mesh netting, including:

large cords cooperating with said net and bag retaining springs and said mesh netting to position said strike zone;

two shoulder target discs located at the two upper corners of said rectangular insert region or strike zone;

two catcher's knee protector target discs located at the two lower corners of said rectangular insert region or strike zone;

simulated catcher's chest protector ribs located at the upper central portion of said rectangular insert region or strike zone;

a compartmentalized ball receiving bag having a mouth attached to said rectangular insert region or strike zone;

said compartmentalized ball receiving bag being separated into three chambers;

an upper chamber of said compartmentalized ball receiving bag;

a lower compartment of said compartmentalized ball receiving bag;

a bag center wall dividing said upper chamber from said lower compartment;

a lower left-hand chamber of said lower compartment;

a lower right-hand chamber of said lower compartment;

a bag divider wall dividing said lower left-hand chamber from said lower right-hand chamber;

reinforcing large cords defining each of said upper chamber, said lower compartment, said lower left-hand chamber and said lower right-hand chamber;

a juncture of said reinforcing large cords at said bag center wall with said bag divider wall; and a simulated catcher's mitt, centrally located beneath said simulated catcher's chest protector ribs and secured to said juncture of said reinforcing large cords at said bag center wall with said bag divider wall.

2. The baseball pitching target of claim 1 wherein said rectangular insert region or strike zone is attached to said mesh netting and said large cords by means of a U-channel structure and secured thereto by means of U-channel fasteners.

3. The baseball pitching target of claim 2 wherein said compartmentalized ball receiving bag is attached to said mesh netting and said large cords by means of said U-channel structure and secured thereto by means of U-channel fasteners.

4. The baseball pitching target of claim 1 including fastening buttons, sufficient in number to secure each of said shoulder target discs, said catcher's knee protector target discs and said catcher's mitt.

* * * * *